United States Patent [19]

Althaus et al.

[11] Patent Number: 4,970,784

[45] Date of Patent: Nov. 20, 1990

[54] RAZOR WITH A PIVOTED DETACHABLE BLADE UNIT

[75] Inventors: Wolfgang Althaus, Wuppertal; Michael Schwarz, Herne, both of Fed. Rep. of Germany

[73] Assignee: Wilkinson Sword Gesellschaft mit beschränkter Haftung, Solingen, Fed. Rep. of Germany

[21] Appl. No.: 401,020

[22] Filed: Aug. 31, 1989

[30] Foreign Application Priority Data

Sep. 8, 1988 [DE] Fed. Rep. of Germany ..... 8811355

[51] Int. Cl.[5] ..... B26B 21/14

[52] U.S. Cl. ..... 30/89; 30/50

[58] Field of Search ..... 30/47, 50, 85, 87–90

[56] References Cited

U.S. PATENT DOCUMENTS

| | | | |
|---|---|---|---|
| 2,386,536 | 10/1945 | Bensel | 30/68 |
| 3,975,820 | 8/1976 | Torance | 30/47 |
| 4,227,302 | 10/1980 | Torrance | 30/47 |
| 4,281,455 | 8/1981 | Dixon et al. | 30/89 X |
| 4,514,904 | 5/1985 | Bond | 30/87 |

FOREIGN PATENT DOCUMENTS

| | | |
|---|---|---|
| 0020816 | 1/1981 | European Pat. Off. . |
| 0077183 | 4/1983 | European Pat. Off. . |
| 390217 | 2/1924 | Fed. Rep. of Germany . |
| 8515020 | 7/1985 | Fed. Rep. of Germany . |
| 2457155 | 12/1980 | France . |
| 1565415 | 4/1980 | United Kingdom . |

*Primary Examiner*—Douglas D. Watts

*Attorney, Agent, or Firm*—Robert W. Becker & Associates

[57] ABSTRACT

A razor having a razor blade unit with a razor blade fixedly disposed in a plastic housing, and also having a handle, on the front end of which the razor blade unit is pivotably mounted via a forked holder that can be opened and closed. The razor blade unit, starting from a spring-loaded neutral position, is pivotable about a pivot axis that extends parallel to the cutting edge of the razor blade. To provide a pivot head razor where the razor blade unit can execute only slight pivot movements relative to the handle during the shaving process, the pivot axis of the forked holder extends in the region of the cutting edge of the razor blade.

18 Claims, 3 Drawing Sheets

RAZOR WITH A PIVOTED DETACHABLE BLADE UNIT

BACKGROUND OF THE INVENTION

1. Field of the Invention

The present invention relates to a razor having a razor blade unit with razor blade means fixedly disposed in a plastic housing, and also having a handle, on a front end of which the razor blade unit is pivotably mounted via a forked holder that can be opened and closed to undo and establish the mounted state respectively. The razor blade unit, starting from a spring-loaded neutral position, is pivotable about a pivot axis that extends parallel to cutting edge means of the razor blade means.

2. Description of the Prior Art

Razors are known where a razor blade unit is removably and pivotably mounted on the front end of the handle via a forked holder. With such pivot head razors, the forked holder of the handle engages the center of the underside of the razor blade unit, whereby the razor blade unit, starting from a spring-loaded neutral position, can be pivoted to both sides of this neutral position within a pivot range of 60° to 70°.

Considerable torque is produced during the shaving process due to the great distance between the pivot axis of the forked holder of the handle and the cutting edge of the razor blade. This torque leads to an unreliable o unsafe guidance of the razor blade and hence to a risk that the user will be cut. Furthermore, the unstable introduction of force from a neutral position in two directions leads to varying contact pressures as a function of the pivot angle.

In addition, with the conventional razors, mounting of the razor blade unit on the handle is always effected in the center, which leads to unreliable guidance as well as to unavoidable play between the mounting bores and the pivot pins.

It is therefore an object of the present invention to provide a pivot head razor that during the shaving process can execute only slight pivot movements of the razor blade unit relative to the handle.

BRIEF DESCRIPTION OF THE DRAWINGS

This object, and other objects and advantages of the present invention, will appear more clearly from the following specification in conjunction with the accompanying schematic drawings, in which, via one exemplary embodiment of the inventive razor having a head in the form of a razor blade unit.

SUMMARY OF THE INVENTION

Figure 1:
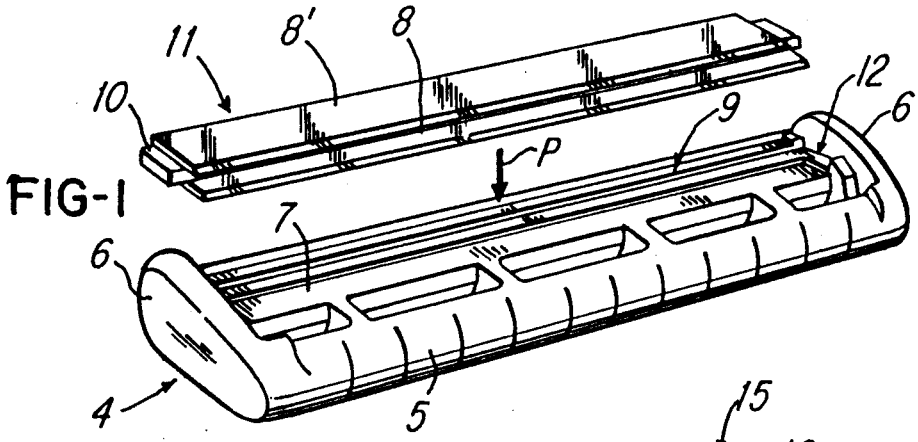
FIG. 1 is a perspective view of a razor blade unit prior to placement of the double razor blade into the plastic housing from above.

The razor of the present invention is characterized primarily in that the pivot axis of the forked holder extends in the region of the cutting edge means of the razor blade means.

A pivot head razor constructed pursuant to the present invention has the advantage that by disposing the pivot axis of the forked holder in the region of the cutting edge means of the razor blade means, the torque that occurs during the shaving process is significantly reduced, so that the pivot movements resulting from the torque during the shaving process are relatively slight. This has in particular the advantage that the razor blade unit conforms exactly to the contour of the face.

Pursuant to one inventive razor having a double razor blade, the pivot axis of the forked holder preferably extends in the region of the cutting edge of the forward razor blade, i.e. that razor blade that normally encounters the face first.

The pivot axis preferably extends in front of the cutting edge of the razor blade and is disposed somewhat below the plane of the blade. This produces optimum shaving characteristics of the pivot head razor, since it is a question of a stable guidance. The introduction of force through the handle is thereby effected in the plane of the force removal to the blades. The pivot axis can also be disposed below a forward guide strip.

Pursuant to a further development of the present invention, the razor blade unit is mounted on the forked holder in the region of the side walls of the plastic housing. This results in a mounting that is disposed far to the outside, which leads to a safe and reliable guidance.

The forked holder is preferably embodied as a spring, in particular a wire spring, that is mounted in the handle and has a control region for the fingers of the user to disengage the spring from the razor blade unit. This represents a technically very straightforward possibility for interlocking or engaging the handle with the razor blade unit, whereby this results in particular in enabling a simple one-hand operation for the user.

Pursuant to one preferred specific embodiment of the present invention, this spring for the forked holder has a U-shaped base element, the forward ends of which are disposed in the plane of the base spring element and are provided with outwardly projecting fork arms, the forward ends of which catch or otherwise engage in corresponding recesses in the razor blade unit to define the mounting positions. The U-shaped base spring element thereby enables a simple disengagement of the forked holder from the razor blade unit by pressing the legs of this base spring element together, so that the forward ends of the fork arms pivot inwardly. The forward ends of the fork arms, in this connection, preferably are in the shape of an S in the plane of the spring and form pivot pins. As a consequence of this bent shape, the forked holder of the handle can easily be introduced into the razor blade unit, so that in a technically very straightforward manner the support points or positions can be placed in the immediate vicinity of the forwardmost cutting edge.

In another preferred specific development of the present invention, the razor blade unit has a stop that cooperates with the forked holder for the neutral position, with the neutral position spring pressing the razor blade unit against this stop, and with the razor blade unit, starting from this neutral position, being pivotable in only one direction, preferably toward the rear. As the so-called neutral position spring, a U-shaped spring, a flat spring, a leg spring, etc. of plastic or metal can be provided. The neutral position spring is preferably disposed on the rear, upper end of the handle, and is supported against the rear underside of the razor blade unit. In any case, this neutral position spring presses the razor blade unit into the neutral position, out of which the razor blade unit can be pivoted in only one direction. The pivot range of the razor blade unit is preferably 15° to 30°. This, together with the close disposition of the pivot axis relative to the cutting edge of the razor blade, results in an optimum configuration of the razor with regard to its shaving characteristics, since due to the fact that the razor blade unit can pivot to only one side, a uniform, optimum contact pressure is assured that is not dependent upon a central position.

Further specific features of the present invention will be described in detail subsequently.

DESCRIPTION OF PREFERRED EMBODIMENTS

Figure 2:
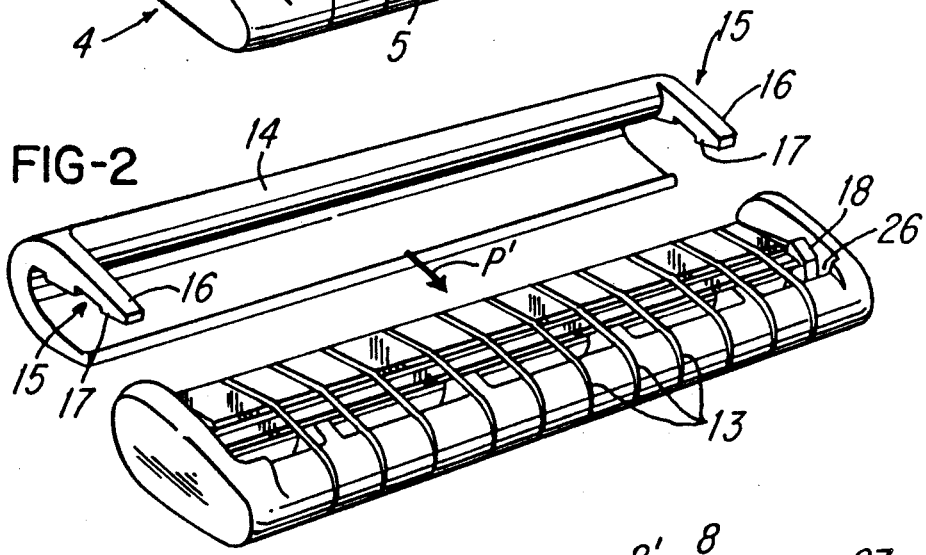
FIG. 2 is a view that shows the razor blade unit of FIG. 1 after the double razor blade has been inserted and wound with wire, but prior to placement of a U-shaped cap onto the plastic housing from the rear.
Figure 3:
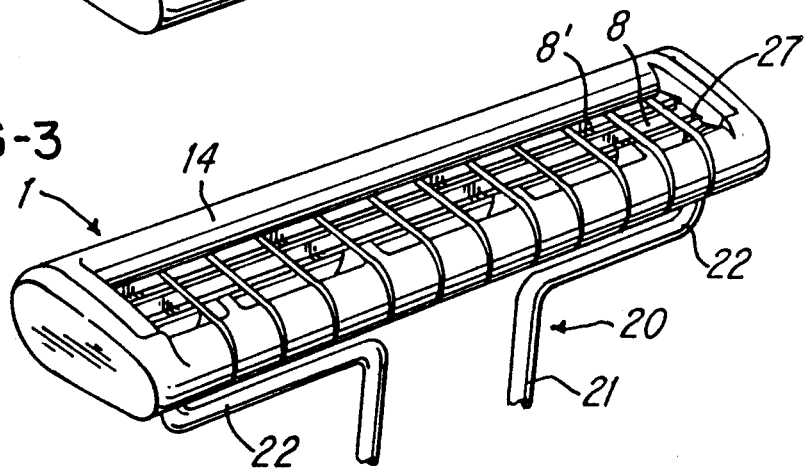
FIG. 3 is a view that shows the assembled razor blade unit, with a forked holder of a handle being indicated for the formation of a razor.
Figure 4:
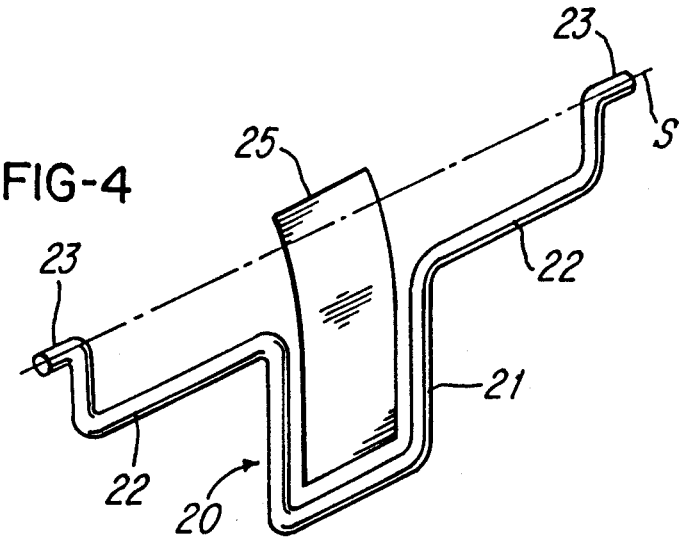
FIG. 4 is a view that shows the forked spring for the holder of the razor blade unit at the front end of the handle, and also shows a neutral position spring in the form of a flat spring.
Figure 5:
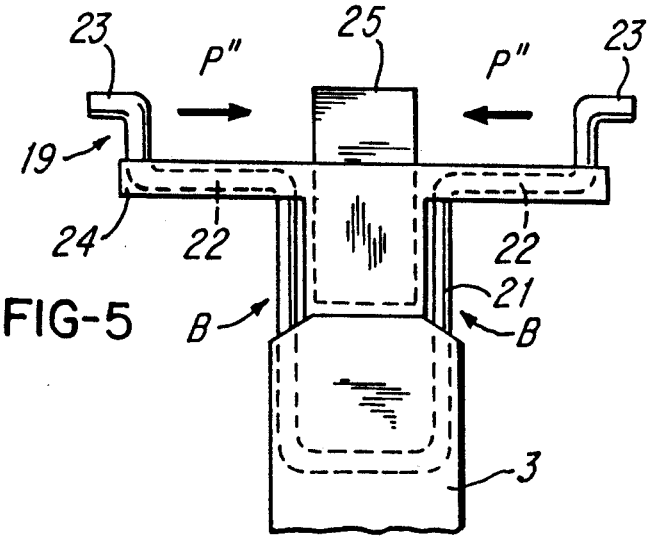
FIG. 5 is a view that shows the springs of FIG. 4 after installation in the handle of the razor.
Figure 6:
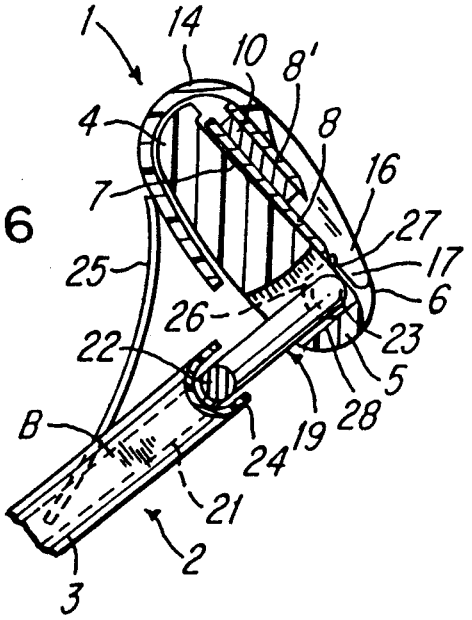
FIG. 6 is a schematic cross-sectional view through the head region of the inventive razor.

Referring now to the drawings in detail, FIGS. 1, 2 and 3 illustrate the various phases for the assembly of a razor blade unit 1, while the schematic cross-sectional view Of FIG. 6 illustrates a complete razor 2, with the razor blade unit 1 of FIGS. 1, 2 and 3 having been secured to the front end of a handle 3. Parts of this handle 3 are illustrated in FIGS. 4 and 5.

The razor blade unit 1 comprises a one-piece plastic housing 4 that has a front guide strip 5, two side walls 6, and a blade platform or support 7 in the interior of the housing.

As shown in FIG. 1, inserted from above into the plastic housing 4 of the razor blade unit 1 through an opening 9 of the housing is a double razor blade comprised of the two blades 8, 8'. For this purpose, the two razor blades 8, 8' are fixedly secured to a flat, elongated, parallelepipedal spacer 10 in such a way that the spacer is sandwiched between the two razor blades 8, 8'. Thus, the razor blades 8, 8' and the spacer 10 form a so-called razor blade/spacer unit 11. As can be seen from FIG. 1, the spacer 10 is somewhat longer than the two razor blades 8, 8', so that the spacer 10 extends somewhat beyond the ends of the razor blades. In conformity with these extensions, each end of the blade support 7 of the razor blade unit 1 is provided with a respective recess 12 in the vicinity of the pertaining side wall 6.

As indicated in FIG. 1, the razor blade/spacer unit 11 is placed into the plastic housing 4 and onto the blade support from above in the direction of the arrow P. Subsequently, as can be seen in FIG. 2, the plastic housing 4, together with the razor blade/spacer unit 11 inserted therein, is wrapped with wire 13.

Since the razor blade/spacer unit 11 is placed only loosely into the opening 9 of the plastic housing 4 and is held merely by the wire 13, a special fixation of the razor blade/spacer unit 11 within the plastic housing 4 must be provided. For this purpose, a cap 14 having an essentially U-shaped cross-sectional profile is provided. The cap 14 extends over the entire length of the plastic housing 4. The upper side of the cap 14 is provided with engagement means 15 comprising engagement arms 16 that extend toward the front from each end and that are each provided with a catch 17 at their front ends. The plastic housing 4 is provided with respective receiving means 18 that correspond to the catches 17.

As can be seen from FIG. 2, the cap 14 is placed onto the plastic housing 4 from behind in the direction of the arrow P' in such a way that the catches 17 of the cap 14 snap or otherwise engage in the receiving means 18 in the plastic housing 4. This finished assembled state of the razor blade unit 1 is illustrated in FIG. 3. Since the upper side of the cap 14 rests upon the razor blade/-spacer unit 11, the latter is firmly secured on the blade support of the plastic housing 4.

To form a razor 2, a handle 3 is provided for the razor blade unit 1. The front end of the handle 3 has a special forked holder 19 via which the handle 3 can catch or otherwise engage in the razor blade unit 1.

The forked holder 19 comprises a spring 20 in the form of a wire spring, which is illustrated in FIG. 4 by itself without the handle S. The spring 20 primarily comprises a U-shaped base spring element 21, the front ends of which are bent outwardly at right angles to form fork arms 22. The front ends of the fork arms 22 are bent in the shape of an S and form pivot pins 23.

FIG. 5 shows how the spring 20 of the forked holder 19 is disposed in the front region of the handle 3. In this connection, the base of the U-shaped base spring element 21 is fixed within the handle 3 in such a way that the legs extend to the front. The fork arms 22 come to rest in a T-shaped extension 24 of the handle 3. As can be seen from FIG. 5, the legs of the base spring element 21 are exposed in the forward region. As a result, actuation or control regions B are formed, so that by pressing together the legs of the base spring element 21, the pivot pins 23 of the spring 20 can be pivoted inwardly toward one another. This is indicated by the arrows P''. After the legs of the base spring element 21 are released, the pivots pins 23 return to their starting position.

Furthermore shown in FIGS. 4 and 5 is a so-called neutral position spring 25, which in the illustrated embodiment is shown as a flat spring of plastic or metal; the bottom or rear end of the spring 25 is disposed in the handle 3. Instead of being embodied as a flat spring, the spring 25 could also be embodied as a U spring, a leg spring, etc. The technical significance of the neutral position spring 25 will be explained subsequently with the aid of FIG. 6.

To secure the handle 3 to the razor blade unit 1, the pivot pins 23 are first pivoted inwardly in the manner described above. As a result, the forked holder 19 can be introduced into the razor blade unit 1, as can be seen in particular in FIGS. 3 and 6. In this connection, the razor blade unit 1 is provided in the region of its side walls 6 with respective recesses 26 into which the pivot pins 23 of the forked holder 19 can engage after the spring 20 is released. As can be seen in particular in FIG. 6, the pivot axis S that is defined by the pivot pins 23 is disposed in the region of the cutting edge 27 of the forward razor blade 8, i.e. the pivot axis S extends in front of this cutting edge 27 and parallel thereto, as well as somewhat offset below the plane of this forward razor blade 8. As can be furthermore seen in FIG. 6, the neutral position spring 25 presses the razor blade unit 1 toward the front against a stop 28 within the plastic housing 4. During the shaving process, the razor blade unit 1 can therefore be pivoted only to the rear against the force of the neutral position spring 25, with the pivot range being between 15° and 30°.

The present invention is, of course, in no way restricted to the specific disclosure of the specification and drawings, but also encompasses any modifications within the scope of the appended claims.

What we claim is:

1. In a razor having a razor blade unit with razor blade means fixedly disposed in a plastic housing, and also having a handle, on a front end of which said razor blade unit is pivotably mounted via a forked holder that can be opened and closed to undo and establish said mounted state respectively, with said razor blade unit, starting from a spring-loaded neutral position, being pivotable about a pivot axis that extends parallel to cutting edge means of said razor blade means, the improvement wherein:

said pivot axis of said forked holder extends in the region of and essentially in line with said cutting edge means of said razor blade means so that during shaving any torque arising via arrangement of said pivot axis is decisively reduced.

2. In a razor blade having a razor blade unit with razor blade means fixedly disposed in a plastic housing, and also having a handle, on a front end of which said razor blade unit is pivotably mounted via a forked holder that can be opened and closed to undo and establish said mounted state respectively, with said razor blade unit, starting from a spring-loaded neutral position, being pivotable about a pivot axis that extends parallel to cutting edge means of said razor blade means, the improvement wherein:

said pivot axis of said forked holder extends in the region of said cutting edge means of said razor blade means, said pivot axis extending in front of said cutting edge means of said blade means.

3. A razor blade according to claim 2, in which said razor blade means includes two blades, with said pivot axis of said forked holder extending in the region of cutting edge means of a forwardmost one of said two razor blades.

4. A razor blade according to claim 2, in which said pivot axis is disposed slightly on that side of a plane defined by said razor blade means that faces said handle.

5. A razor blade according to claim 2, in which said plastic housing includes a front guide strip, with said pivot axis being disposed below said guide strip.

6. A razor blade according to claim 2, in which said plastic housing has side walls that extend essentially perpendicular to said pivot axis, with said razor blade unit being mounted to said forked holder in the vicinity of said side walls.

7. In a razor blade having a razor blade unit with razor blade means fixedly disposed in a plastic housing, and also having a handle, on a front end of which said razor blade unit is pivotably mounted via a forked holder that can be opened and closed to undo and establish said mounted state respectively, with said razor blade unit, starting from a spring-loaded neutral position, being pivotable about a pivot axis that extends parallel to cutting edge means of said razor blade means, the improvement wherein:

said pivot axis of said forked holder extends in the region of said cutting edge means of said razor blade means, said plastic housing having side walls that extend essentially perpendicular to said pivot axis, with said razor blade unit being mounted to said forked holder in the vicinity of said side walls, said forked holder being in the form of a spring that is mounted in said handle, with said spring being provided with a control region for fingers of a user for disengagement of said spring from said razor blade unit.

8. A razor blade according to claim 7, in which said spring is a wire spring.

9. A razor blade according to claim 7, in which said spring has a U-shaped base spring element having forward ends that are disposed in the plane of said base spring element and that have fork arms that extend outwardly and away from one another, with said fork arms having forward ends that are designed to engage in recess means of said plastic housing and that define pivot points of said pivot axis.

10. A razor blade according to claim 9, in which said forward ends of said fork arms are respectively bent in the shape of an S, in the plane of said spring, and form pivot pins.

11. In a razor blade having a razor blade unit with razor blade means fixedly disposed in a plastic housing, and also having a handle, on a front end of which said razor blade unit is pivotably mounted via a forked holder that can be opened and closed to undo and establish said mounted state respectively, with said razor blade unit, starting from a spring-loaded neutral position, being pivotable about a pivot axis that extends parallel to cutting edge means of said razor blade means, the improvement wherein:

said pivot axis of said forked holder extends in the region of said cutting edge means of said razor blade means, said razor blade unit being provided with stop means that cooperates with said forked holder for said neutral position; and a neutral position spring for pressing said razor blade unit against said stop means, with said razor blade unit, starting from said neutral position, being pivotable in only one direction.

12. A razor blade according to claim 11, in which said razor blade unit is pivotable only to the rear.

13. A razor blade according to claim 11, in which said neutral position spring is made of one of the materials selected from the group consisting of plastic and metal.

14. A razor blade according to claim 13, in which said neutral position spring is a U-shaped spring.

15. A razor blade according to claim 13, in which said neutral position spring is a flat spring.

16. A razor blade according to claim 13, in which said neutral position spring is a leg spring.

17. A razor blade according to claim 11, in which said neutral position spring is mounted on a rear, upper end of said handle and is supported against a rear underside of said razor blade unit.

18. A razor blade according to claim 17, in which the pivot range of said razor blade unit is from 15° to 30°.

* * * * *